US008303355B2

(12) United States Patent
Ono et al.

(10) Patent No.: US 8,303,355 B2
(45) Date of Patent: Nov. 6, 2012

(54) TERMINAL CONNECTOR AND ELECTRIC WIRE WITH TERMINAL CONNECTOR

(75) Inventors: Junichi Ono, Yokkaichi (JP); Hiroki Hirai, Yokkaichi (JP); Tetsuji Tanaka, Yokkaichi (JP); Hiroki Shimoda, Yokkaichi (JP); Takuji Otsuka, Yokkaichi (JP); Kenji Okamura, Yokkaichi (JP); Masaaki Tabata, Yokkaichi (JP)

(73) Assignees: Sumitomo Wiring Systems, Ltd., Yokkaichi-Shi (JP); Autonetworks Technologies, Ltd., Yokkaichi-Shi (JP); Sumitomo Electric Industries, Ltd., Osaka-Shi (JP)

( * ) Notice: Subject to any disclaimer, the term of this patent is extended or adjusted under 35 U.S.C. 154(b) by 199 days.

(21) Appl. No.: 12/867,987

(22) PCT Filed: Jun. 10, 2009

(86) PCT No.: PCT/JP2009/060594

§ 371 (c)(1),
(2), (4) Date: Aug. 17, 2010

(87) PCT Pub. No.: WO2009/154109

PCT Pub. Date: Dec. 23, 2009

(65) Prior Publication Data

US 2011/0003518 A1 Jan. 6, 2011

(30) Foreign Application Priority Data

Jun. 20, 2008 (JP) ..... 2008-162426

(51) Int. Cl.
*H01R 4/18* (2006.01)

(52) U.S. Cl. ..... 439/877

(58) Field of Classification Search ..... 439/877, 439/882, 844

See application file for complete search history.

(56) References Cited

U.S. PATENT DOCUMENTS

| | | | | |
|---|---|---|---|---|
| 5,316,506 | A * | 5/1994 | Ito | 439/879 |
| 5,370,560 | A * | 12/1994 | Ito | 439/877 |
| 6,056,605 | A * | 5/2000 | Nguyen et al. | 439/882 |
| 7,252,559 | B1 * | 8/2007 | Morello et al. | 439/843 |
| 2005/0266727 | A1 * | 12/2005 | Yamaguchi et al. | 439/585 |

FOREIGN PATENT DOCUMENTS

| | | |
|---|---|---|
| JP | U1-51-80683 | 6/1976 |
| JP | A-5-152011 | 6/1993 |
| JP | A-10-125362 | 5/1998 |
| JP | A-11-515137 | 12/1999 |
| JP | A-2000-335346 | 12/2000 |
| JP | A-2005-327690 | 11/2005 |

OTHER PUBLICATIONS

Written Opinion of the International Searching Authority issued in Patent Application No. PCT/JP2009/060594, dated Jul. 28, 2009 (with translation).

International Search Report issued in Patent Application No. PCT/JP2009/060594, dated Jul. 28, 2009 (with translation).

* cited by examiner

*Primary Examiner* — Alexander Gilman

(74) *Attorney, Agent, or Firm* — Oliff & Berridge, PLC

(57) ABSTRACT

Rims of an opening of each recess form a parallelogram, and comprise two first opening rims that are parallel to a first direction and two second opening rims that are parallel to a second direction. The first opening rims of each of the recesses that are aligned along the first direction are arranged on a straight line along the first direction. The second opening rims of each of the recesses that are aligned along the second direction are arranged on a straight line along the second direction. The recesses are formed by pressing a wire barrel with a die where a plurality of protruding parts are formed so as to correspond to the recesses.

16 Claims, 7 Drawing Sheets

TERMINAL CONNECTOR AND ELECTRIC WIRE WITH TERMINAL CONNECTOR

TECHNICAL FIELD

The present invention relates to a terminal connector and an electric wire with a terminal connector.

BACKGROUND ART

Conventionally, a terminal connector that is connected to an end of an electric wire disclosed in Patent Document 1 is known as an example of such a kind. The terminal connector is formed by pressing a metal plate material and comprises a crimping portion that is crimped onto a core wire exposed from an end of an electric wire.

An oxide layer is formed on a surface of the core wire, and the oxide layer is interposed between the core wire and the crimping portion. This may increase a contact resistance between the core wire and the crimping portion.

In the prior art, recesses (serrations) are formed on an inner side (a side closer to the core wire) of the crimping portion. The recesses are continuously extended in a direction crossing to an extending direction of the electric wire. A plurality of recesses are aligned along the extending direction of the electric wire and formed by pressing a metal plate material with a die.

When the crimping portion is crimped onto the core wire of the electric wire, the core wire is pressed to the crimping portion so as to be plastically deformed in the extending direction of the electric wire. Then, the oxide layer formed on the surface of the core wire rubs against opening edges of the recesses and removed therefrom. Then, the surface of the core wire emerges and comes into contact with the crimping portion. This reduces a contact resistance between the electric wire and the terminal connector. [Patent Document 1] Japanese Unexamined Patent Publication No. JP-10-125362

Recently, it has been considered that aluminum or aluminum alloy is used as a material of the core wire. The oxide layer is comparatively easily formed on a surface of aluminum or aluminum alloy. Therefore, if aluminum or aluminum alloy is used for the core wire of the electric wire, a contact resistance between the core wire and the crimping portion may not be sufficiently reduced even if the recesses are formed.

It is thought that a plurality of recesses are aligned along the extending direction of the electric wire and also aligned along a crossing direction crossing to the extending direction of the electric wire. Accordingly, a total area of the opening edges of the recesses is increased compared to a case in which the recesses are aligned only in the extending direction of the electric wire. Therefore, it is expected that the oxide layer formed on the core wire is surely removed.

However, according to the above configuration, manufacturing cost of the die for forming the recesses may be increased due to the following reason. Protruding parts are formed at positions in the die so as to correspond to the recesses. The protruding parts are formed by cutting a metal plate material. At this time, there may be occurred a case in that the metal plate material should be cut by electro-discharge machining according to the arrangement of the recesses. This increases manufacturing cost of the die.

Therefore, there is a need in the art to provide a terminal connector and an electric wire with a terminal connector that reduces a contact resistance with the electric wire and reduces manufacturing cost of a die.

SUMMARY

The present invention provides the terminal connector comprising a crimping portion that is crimped onto a conductor exposed at an end of an electric wire so as to surround the exposed conductor. In a state before the crimping portion is crimped onto the electric wire, a plurality of recesses are arranged on a surface of the crimping portion where the electric wire is provided, so as to be aligned along a first direction with a distance therebetween, the first direction crossing to an extending direction in which the electric wire that is crimped onto the crimping portion is extended, and the plurality of recesses are arranged to be aligned along a second direction with a distance therebetween, the second direction crossing to the extending direction and being different from the first direction, and rims of an opening of each recess form a parallelogram and comprise two first opening rims parallel to the first direction and two second opening rims parallel to the second direction, and the first opening rims of each of the recesses that are arranged in the first direction are arranged on a straight line along the first direction and the second opening rims of each of the recesses that are arranged in the second direction are arranged on a straight line along the second direction. The recesses are formed by pressing the crimping portion with a die where a plurality of protruding parts are formed corresponding to the recesses.

The present invention provides the electric wire with a terminal connector comprising an electric wire having a conductor and the terminal connector that is crimped onto an end of the electric wire.

According to the present invention, an edge formed on the rims of the opening of each recess removes an oxide layer that is formed on a surface of a conductor such that the surface of the conductor emerges. The electric wire and the terminal connector are electrically connected to each other by the contact of the emerging surface and the crimping portion. This reduces a contact resistance between the conductor and the terminal connector.

According to the present invention, the protruding parts are formed in the die for forming the recesses so as to correspond to the recesses. To form the protruding parts, areas of a surface of a metal plate material that do not correspond to the recesses are cut so as to remain the areas corresponding to the recesses. Further, according to the present invention, on a surface of the crimping portion where the electric wire is provided, areas that do not correspond to the recesses are formed so as to extend in the first direction and in the second direction in a belt-like state. Therefore, to form the protruding parts, a plurality of grooves extending in the belt-like state in the first direction are formed in the surface of the metal plate material by a cutting work and a plurality of grooves extending in the belt-like state in the second direction are formed in the surface of the metal plate material by a cutting work. This reduces manufacturing cost of the die.

DESCRIPTION OF THE REFERENCE NUMERALS

10 ELECTRIC WIRE WITH A TERMINAL CONNECTOR
11 ELECTRIC WIRE
12 FEMALE TERMINAL CONNECTOR (TERMINAL CONNECTOR)
13 CORE WIRE (CONDUCTOR)
16 WIRE BARREL (CRIMPING PORTION)
17 CONNECTING PORTION
18 RECESS
19 FIRST OPENING RIM
19A END SIDE OPENING RIM
19B WIRE SIDE OPENING RIM
20 SECOND OPENING RIM
21 INCLINED SURFACE
22 FIRST INCLINED SURFACE
25 PROTRUDING PART
24 DIE

BEST MODES FOR CARRYING OUT THE INVENTION

Figure 1:
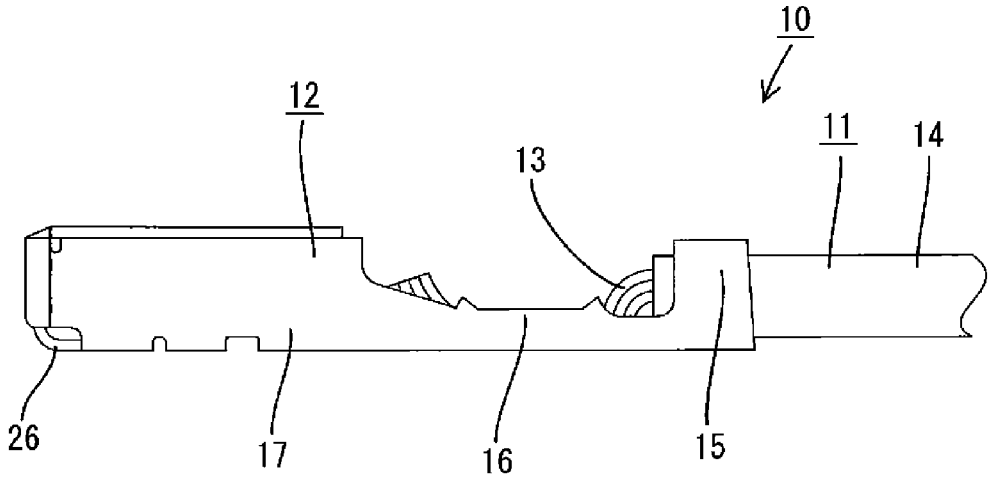
FIG. 1 is a side view illustrating an electric wire with a terminal connector according to the present embodiment.

One embodiment of the present invention will be explained with reference to FIG. 1 through FIG. 7. As illustrated in FIG. 1, the present embodiment provides an electric wire with a terminal connector 10 wherein a female terminal connector (corresponding to a terminal connector of the present invention) 12 is crimped onto a core wire (corresponding to a conductor of the present invention) 13 that is exposed from an end of an electric wire 11.

(Electric Wire 11)

As illustrated in FIG. 1, the electric wire 11 comprises the core wire 13 and wire insulation 14. The core wire 13 is a stranded wire including a plurality of metal thin wires. The wire insulation 14 is made of an insulating synthetic resin and formed so as to surround an outer periphery of the core wire 13. Any metal suitable for intended application such as copper, copper alloy, aluminum, aluminum alloy or other metals can be used for the metal thin wire. In the present embodiment, aluminum alloy is used for the core wire 13. As illustrated in FIG. 1, the wire insulation 14 is removed at the end of the electric wire 11 so as to expose the core wire 13.

(Female Terminal Connector 12)

Figure 3:
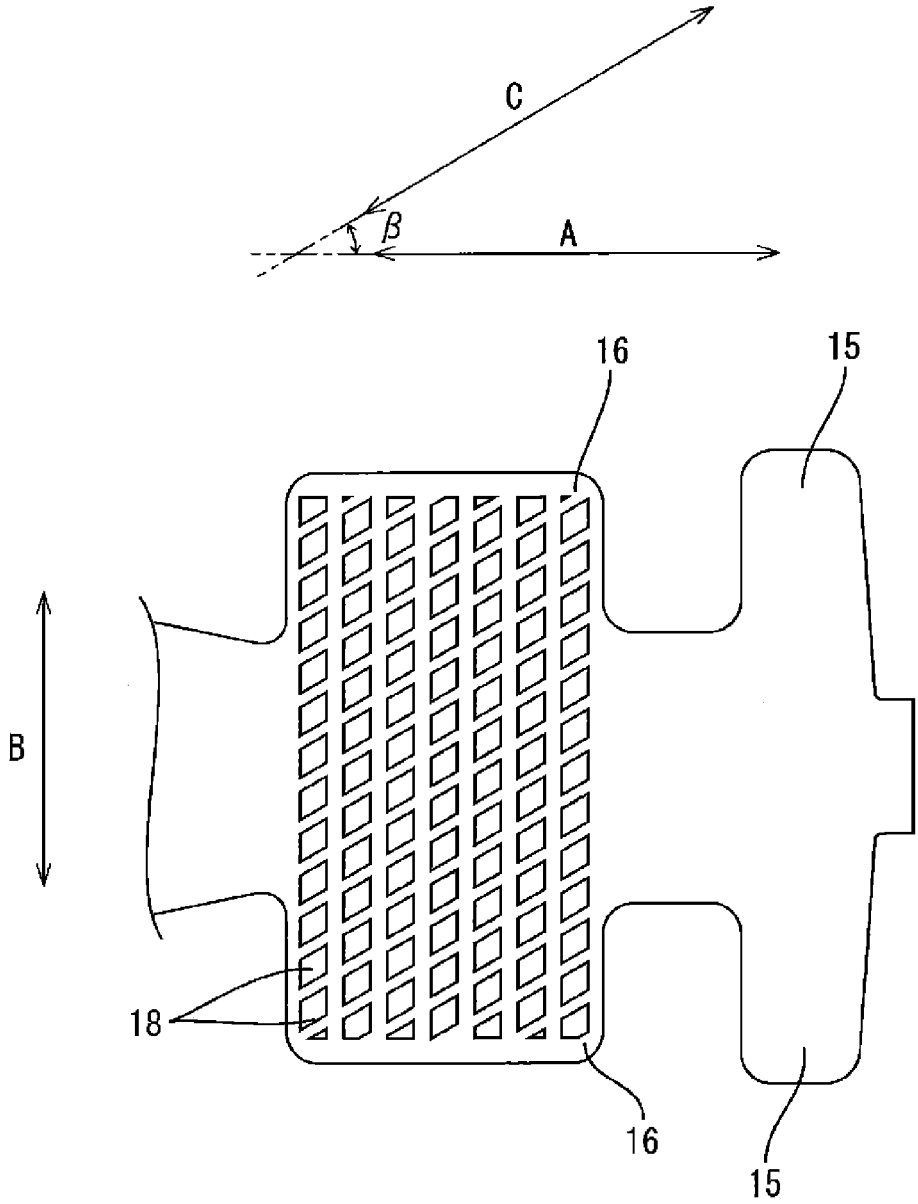
FIG. 3 is an enlarged plan view illustrating a main portion of the female terminal connector in an exploded state.

A metal plate material is pressed into a predetermined shape by a die (not shown) to form the female terminal connector 12. The female terminal connector 12 comprises an insulation barrel 15, a wire barrel 16 (corresponding to the crimping portion of the present invention) and a connecting portion 17. The insulation barrel 15 is crimped to surround an outer periphery of the wire insulation 14 of the electric wire 11. The wire barrel 16 is continuously formed from the insulation barrel 15 and crimped so as to surround the core wire 13. The connecting portion 17 is continuously formed from the wire barrel 16 and connected to a male terminal connector (not shown). As illustrated in FIG. 3, the insulation barrel 15 is foamed to have two plate portions each of which extends in an upper direction and a lower direction.

Figure 2:
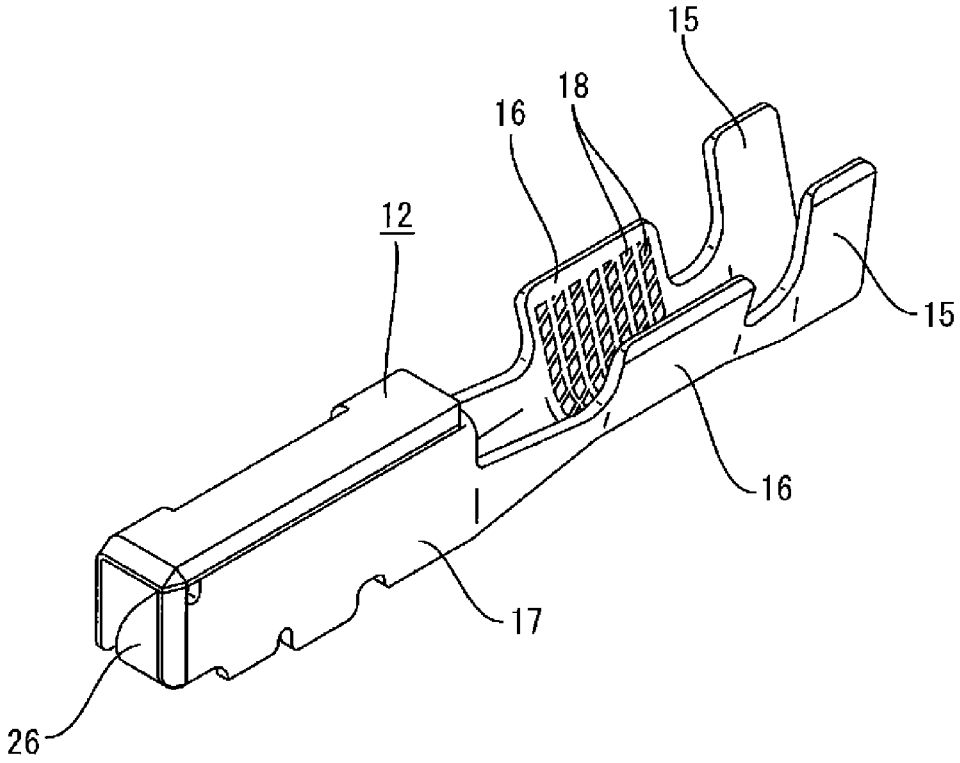
FIG. 2 is a perspective view illustrating a female terminal connector.

As illustrated in FIG. 2, the connecting portion 17 is formed in a tubular shape so as to receive a male tab (not shown) of the male terminal connector. An elastic contact portion 26 is formed in the connecting portion 17. The elastic contact portion 26 is elastically contacted to the male tab of the male terminal connector so as to electrically connect the male terminal connector and the female terminal connector 12.

In the present embodiment, the female terminal connector 12 is formed in a tubular shape and has the connecting portion 17. However, it is not limited thereto and for example, the male terminal connector having the male tab or an LA terminal that is formed by forming a penetration hole in a metal plate material may be provided instead of the female terminal connector 12. The terminal connector may be formed in any shape suitable for intended application.

(Wire Barrel 16)

FIG. 3 shows an enlarged plan view of a main portion of the wire barrel 16 in its exploded state (in a state before being crimped onto the electric wire). As illustrated in FIG. 3, the wire barrel 16 is formed to have two plate portions each of which extends in an upper direction and a lower direction in FIG. 3. Before being crimped onto the electric wire, the wire barrel 16 is formed in a substantially rectangular shape seen from a direction penetrating through a paper of FIG. 3.

As illustrated in FIG. 3, a plurality of recesses 18 are formed in a surface of the wire barrel 16 where the electric wire is provided at the time of crimping of the electric wire (a surface at a front side in a direction penetrating through the paper of FIG. 3). Rims of an opening of each recess 18 form a shape of a parallelogram seen from the direction penetrating through the paper of FIG. 3 before the electric wire is crimped.

As illustrated in FIG. 3, the recesses 18 are arranged in an extending direction of the core wire 13 in a state in that the wire barrel 16 is crimped onto the core wire 13 (a direction shown by an arrow A in FIG. 3) with a distance therebetween.

Further, as illustrated in FIG. 3, the recesses 18 are arranged in a first direction (a direction shown by an arrow B in FIG. 3) crossing to the extending direction of the core wire 13 (a direction shown by an arrow A in FIG. 3) with a distance therebetween. In the present embodiment, the first direction crosses at an angle ranging from 85 degrees to 90 degrees to the extending direction. In the present embodiment, the first direction crosses at substantially 90 degrees to the extending direction. The first direction may cross to the extending direction at any angle suitable for intended application.

Further, as illustrated in FIG. 3, the recesses 18 are arranged so as to cross at an angle $\beta$ to the extending direction of the core wire 13 (the direction shown by the arrow A in FIG. 3) and to be aligned along a second direction (a direction shown by an arrow C in FIG. 3) that is different from the first direction with a distance therebetween. In the present embodiment, the angle $\beta$ is set to be substantially 30 degrees.

Figure 4:
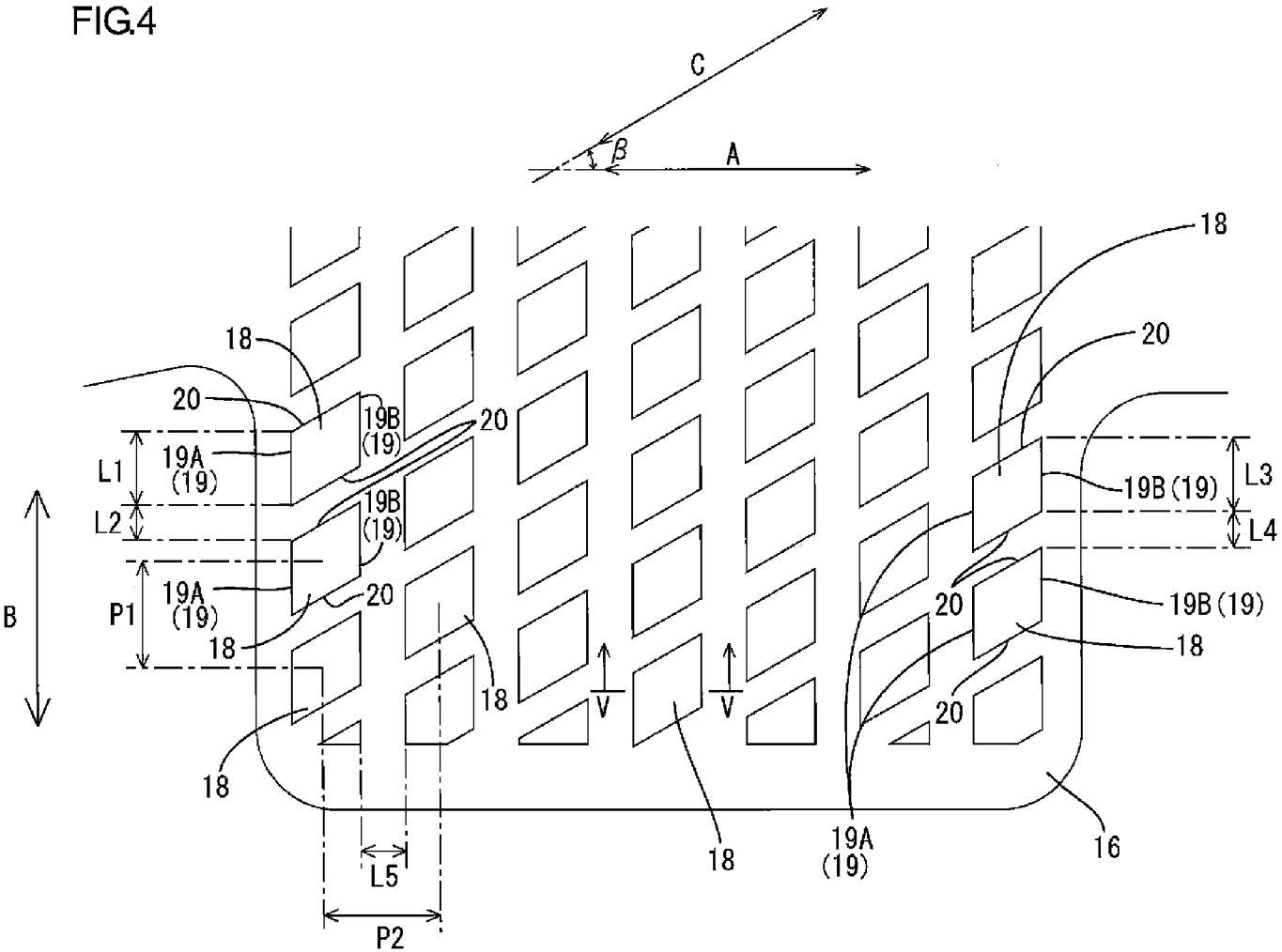
FIG. 4 is an enlarged plan view illustrating a main portion of recesses formed in a wire barrel.

As illustrated in FIG. 4, the rims of the opening of each recess 18 include two first opening rims 19 that are parallel to the first direction (the direction shown by the arrow B in FIG. 4). In the present embodiment, the first opening rims 19 cross at an angle ranging from 85 degrees to 95 degrees to the extending direction (the direction shown by the arrow A in FIG. 4). In FIG. 4, description of an inner structure of the recess 18 is omitted.

The first opening rims 19 of each of the recesses 18 that are aligned along the first direction (the direction shown by the arrow B in FIG. 4) are arranged on a straight line along the first direction. The first opening rims 19 comprise an end side opening rim 19A and a wire side opening rim 19B. The end side opening rim 19A is located closer to an end side of the electric wire 11 (a left side in FIG. 4). The wire side opening rim 19B is located closer to an opposite side of the end side of the electric wire 11 (a right side in FIG. 4).

Further, as illustrated in FIG. 4, sides forming the rims of the opening of each recess 18 have two second opening rims 20 that are parallel to the second direction (the direction shown by the arrow C in FIG. 4). The second opening rims 20 of each of the recesses 18 that are aligned along the second direction are arranged on a straight line along the second direction.

As illustrated in FIG. 4, a length L1 of the end side opening rim 19A is set to be a distance L2 or greater. The distance L2 is a distance between the end side opening rims 19A, 19A of the recesses 18 that are arranged adjacent to each other in the first direction (the direction shown by the arrow B in FIG. 4). Accordingly, the end side opening rims 19A of the recesses that are arranged adjacent to each other in the extending direction (the direction shown by the arrow A in FIG. 4) so as to overlap with each other in the extending direction. Specifically, in the plurality of recesses 18, the end side opening rim 19A of one recess 18 overlaps with the end side opening rims 19A, 19A of another plurality of recesses 18, 18 (two in the present embodiment) in the extending direction, and the another plurality of recesses 18, 18 are arranged adjacent to the one recess 18 in the extending direction and aligned along the first direction.

Similar to the above, a length L3 of the wire side opening rim 19B is set to be a distance L4 or greater. The distance L4 is a distance between the wire side opening rims 19B, 19B of the recesses 18 that are arranged adjacent to each other in the first direction (the direction shown by the arrow B in FIG. 4). Accordingly, the wire side opening rims 19B of a plurality of recesses that are arranged adjacent to each other in the extending direction (the direction shown by the arrow A in FIG. 4) are arranged to overlap with each other in the extending direction. Specifically, in the plurality of recesses 18, the wire side opening rim 1913 of one recess 18 overlaps with the wire side opening rims 19B, 19B of another plurality of recesses 18, 18 (two in the present embodiment) in the extending direction, and the another plurality of recesses 18, 18 are arranged adjacent to the one recess 18 in the extending direction and aligned along the first direction.

As illustrated in FIG. 4, the angle β that is formed by the extending direction (the direction shown by the arrow A in FIG. 4) and the second direction (the direction shown by the arrow C) is set so as to satisfy the following condition. In the plurality of recesses 18, the end side opening rim 19A of one recess 18 overlaps with the end side opening rims 19A of another plurality of recesses 18, 18 (two in the present embodiment) in the extending direction, and the another plurality of recesses 18, 18 are arranged adjacent to the one recess 18 in the extending direction and aligned along the second direction. In the present embodiment, the angle β is set to be 30 degrees.

Similar to the above, the angle β that is formed by the extending direction (the direction shown by the arrow A in FIG. 4) and the second direction (the direction shown by the arrow C) is set so as to satisfy the following condition. In the plurality of recesses 18, the wire side opening rim 19B of one recess 18 overlaps with the wire side opening rims 19B of another plurality of recesses 18, 18 (two in the present embodiment) in the extending direction, and the another plurality of recesses 18, 18 are arranged adjacent to the one recess 18 in the extending direction and aligned along the second direction.

As illustrated in FIG. 4, in the plurality of recesses 18, a pitch distance P1 between the recesses 18 in the first direction (the direction shown by the arrow B in FIG. 4) crossing to the extending direction of the core wire 13 (the direction shown by the arrow A in FIG. 4) is set to be within a range from 0.1 mm to 0.8 mm. In the present embodiment, P1 is set to be 0.5 mm. The pitch distance P1 is a distance in the first direction between an intersection point of the diagonal lines of one recess 18 and an intersection point of the diagonal lines of another recess 18 that is located next to the one recess 18.

The distance between the recesses 18 that are positioned adjacent to each other in the first direction (the direction shown by the arrow B in FIG. 4) is set to be the distance L2 between the end side opening rims 19A and the distance L4 between the wire end opening rims 19B as described above in the present embodiment. The distance between the recesses 18 is set to be 0.1 mm or more and to be a half or less of the pitch distance P1 between the recesses in the first direction (the direction shown by the arrow B in FIG. 4). In the present embodiment, the distance between the recesses 18 is set to be 0.1 mm.

As illustrated in FIG. 4, a pitch distance P2 between the recesses 18 in the extending direction (the direction shown by the arrow A in FIG. 4) is set to be within the range from 0.3 mm to 0.8 mm. In the present embodiment, P2 is set to be 0.5 mm. The pitch distance P2 is a distance in the extending direction between an intersection point of the diagonal lines of one recess 18 and an intersection point of the diagonal lines of another recess 18 that is located next to the one recess 18.

A distance L5 between the recesses 18 that are positioned adjacent to each other in the extending direction (the direction shown by the arrow A in FIG. 4) is 0.1 mm or more and the distance L5 is set to be a value or less that is obtained by subtracting 0.1 mm from the pitch distance P2 between the recesses 18 that are positioned adjacent to each other in the extending direction. In the present embodiment, L5 is set to be 0.2 nm.

Figure 5:
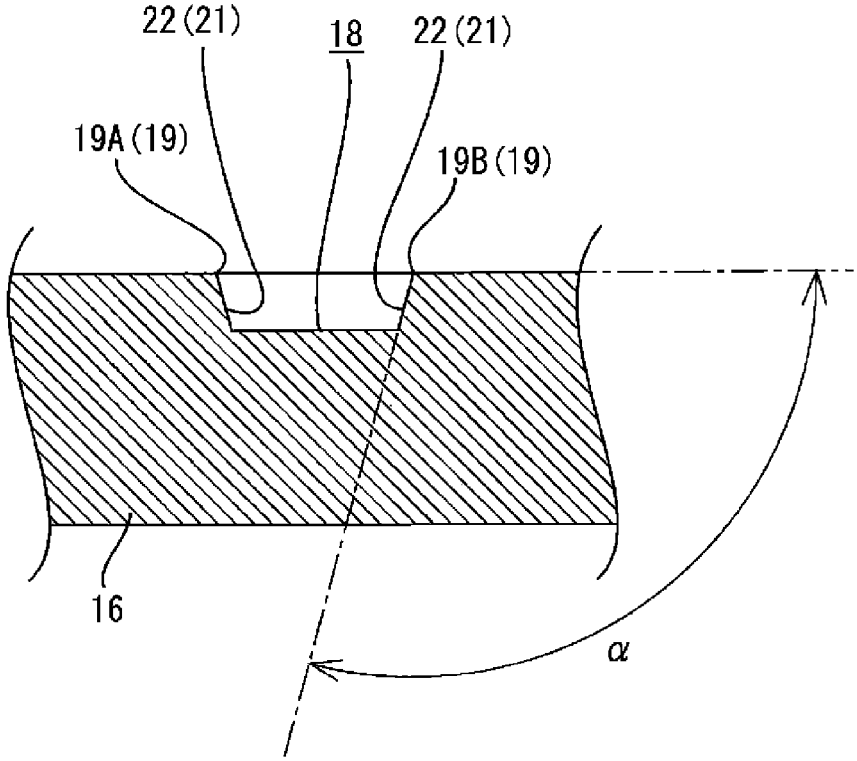
FIG. 5 is a sectional view of FIG. 4 taken along a V-V line.

As illustrated in FIG. 5, a bottom surface of the recess 18 is formed so as to be smaller than a whole size of the rims of the opening of the recess 18. Accordingly, the bottom surface of the recess 18 is connected to the rims of the opening of the recess 18 by four inclined surfaces 21 that are inclined to spread from the bottom surface of the recess 18 toward the rims of the opening of the recess 18. Two inclined surfaces 21 are described in FIG. 5.

As illustrated in FIG. 5, the inclined surfaces 21 each of which connects each of the two first opening rims 19 and the bottom surface of the recess 18 are referred to as first inclined surfaces 22. An angle α formed by the first inclined surface 22 and a surface of the wire barrel 16 where the core wire 13 is provided is set to satisfy a condition that the angle α is within the range from 90 degrees to 110 degrees. In the present embodiment, the angle α is set to be 105 degrees.

In the present embodiment, the compression rate of the core wire 13 that is crimped onto the wire barrel 16 is expressed by a percent of the cross-sectional area of the core wire 13 after being crimped onto the wire barrel 16 with respect to the cross-sectional area of the core wire 13 before being crimped onto the wire barrel 16. Specifically, the compression rate is set to be within the range from 40% to 70%. In the present embodiment, the compression rate is set to be 60%.

Figure 6:
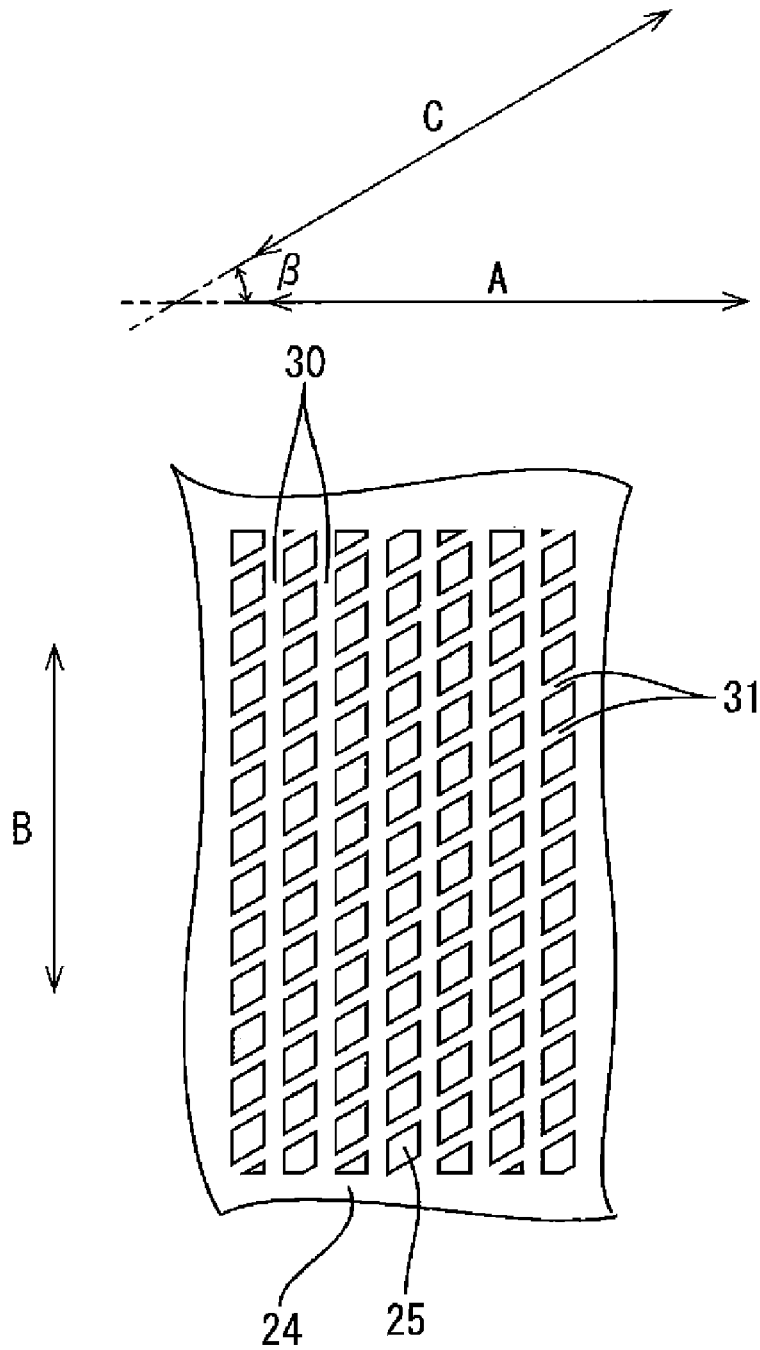
FIG. 6 is an enlarged plan view illustrating a main portion of a die.

The recesses 18 are formed by pressing the wire barrel 16 with a die 24 illustrated in FIG. 6. A plurality of protruding parts 25 are formed in the die 24 corresponding to the recesses 18 so as to be projected toward the front direction in a direction penetrating through the paper. In FIG. 6, description of a detailed configuration of the protruding parts 25 is omitted.

Next, operations and effects of the present embodiment will be explained. The following shows one example of a process for attaching the female terminal connector 12 to the electrical wire 11. First, a metal plate material is formed in a predetermined shape by press molding with a die. At this time, the recesses 18 may be formed simultaneously.

Thereafter, the metal plate material that is formed in the predetermined shape is processed to be bent to form the connecting portion 17 (see FIG. 2). At this time, the recesses 18 may be formed.

As illustrated in FIG. 6, a plurality of protruding parts are formed in the die for the press molding of the female terminal connector 12 so as to correspond to the recesses 18 of the wire barrel 16. To form the protruding parts 25, areas of the surface of the metal plate material (not shown) that do not correspond to the recesses 18 are cut so as to remain the areas corresponding to the recesses 18 formed in the wire barrel 16.

A shape of the areas that do not correspond to the recesses 18 is explained. As illustrated in FIG. 4, the recesses 18 formed in the wire barrel 16 are formed to be aligned along the first direction (the direction shown by the arrow B) with a distance therebetween and also formed to be aligned along the second direction (the direction shown by the arrow C) with a distance therebetween. Further, the first opening rims 19 of each recess 18 are arranged on a straight line along the first direction (the direction shown by the arrow B), and the second opening rims 20 of each recess 18 are arranged on a straight line along in the second direction (the direction shown by the arrow C).

Therefore, on the surface of the wire barrel 16 where the electric wire 11 is provided, the areas that do not correspond to the recesses 18 are formed so as to extend in the first direction (the direction shown by the arrow B) and in the second direction (the direction shown by the arrow C) in a belt-like state.

Therefore, to form the protruding parts 25, a plurality of grooves 30 extending in the belt-like state in the first direction are formed by a cutting work and a plurality of grooves 31 extending in the belt-like state in the second direction are formed by a cutting work. This reduces manufacturing cost of the die.

Subsequently, the wire insulation 14 of the electric wire 11 is removed to expose the core wire 13. In a state in that the core wire 13 is positioned on the wire barrel 16 and the wire insulation 14 is positioned on the insulation barrel 15, the barrels 15, 16 are crimped onto the electric wire 11.

Figure 7:
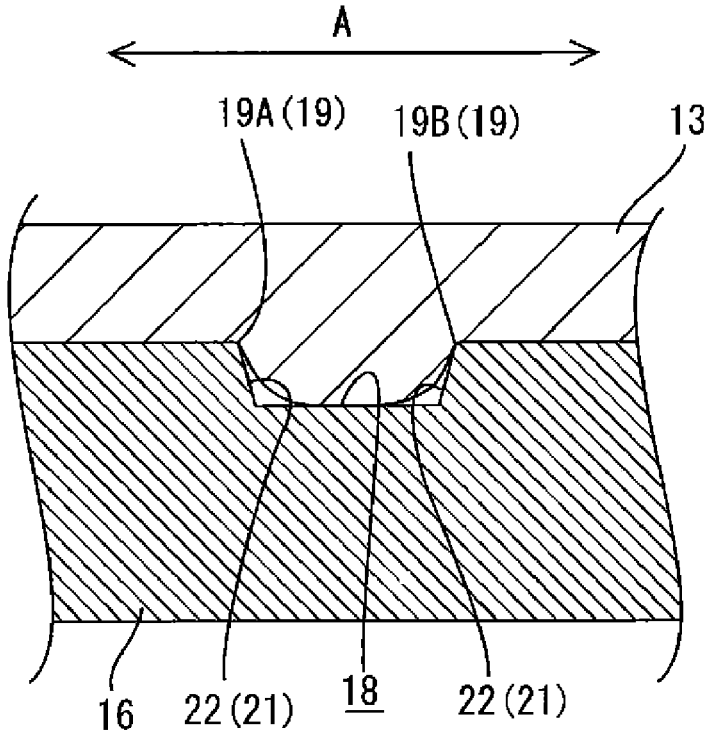
FIG. 7 is an enlarged sectional view illustrating a state in that a wire barrel is crimped onto a core wire.

When the wire barrel 16 is crimped onto the core wire 13, the core wire 13 is pressed by the wire barrel 16 to be plastically deformed and extended in the extending direction of the core wire 13 (the direction shown by the arrow A in FIG. 7) as illustrated in FIG. 7. Then, the outer peripheral surface of the core wire 13 rubs against an edge of the rims of the opening of each recess 18. Accordingly, the oxide layer formed on the outer peripheral surface of the core wire 13 is removed and the surface of the core wire 13 emerges. The core wire 13 and the wire barrel 16 are electrically connected to each other by the contact of the emerging surface and the wire barrel 16. In FIG. 7, the cross-section of a plurality of core wires 13 is schematically shown as a whole.

Since a plurality of recesses 18 are formed, a total length of the rims of the opening of the recesses 18 is increased. This increases a total length of the edges formed on the rims of the opening of the recesses 18. This also increases a total area of the core wire 13 which the edges formed on the rims of the opening of the recesses 18 bite into. This suppresses generation of a gap between the core wire 13 and the wire barrel 16 even if the cooling and heating cycle is repeated. Accordingly, the cooling and heating ability is improved.

The first opening rims 19 forming the rims of the opening of the recess 18 cross to the extending direction of the electric wire at an angle of substantially 90 degrees. Accordingly, when a force in the extending direction of the electric wire 11 is applied to the electric wire 11 that is crimped onto the wire barrel 16, the edges formed on the first opening rims 19 bite into the core wire 13. This increases a holding force of the wire barrel 16 for holding the core wire 13.

Further, the first opening rims 19 of a plurality of recesses 18 that are arranged adjacent to each other in the extending direction are arranged so as to overlap with each other in the extending direction. Therefore, there is surely an area of the core wire 13 which the edge formed on the first opening rims 19 bites into in the extending direction of the electric wire 11. This further increases a holding force of the wire barrel 16 for holding the core wire 13.

According to the present embodiment, the first opening rims 19 comprise the end side opening rim 19A and the wire side opening rim 19B. The end side opening rim 19A is one of the sides forming the rims of the opening of the recess 18 that is located closer to the end side of the electric wire 11. The wire side opening rim 19B is one of the sides forming the rims of the opening of the recess 18 that is located closer to an opposite side of the end side of the electric wire 11. When a force is applied to the electric wire 11 in a direction toward the end side, the core wire is surely held by the end side opening rim 19A. When a force is applied to the electric wire 11 in a direction toward the opposite side of the end side, the core wire is surely held by the wire side opening rim 19B.

Further, in the present embodiment, the angle β formed by the first direction and the second direction is substantially 30 degrees. In the plurality of recesses 18, the end side opening rim 19A of one recess 18 overlaps with the end side opening rims 19A, 19A of another two recesses 18, 18 in the extending direction, and the another two recesses 18, 18 are arranged adjacent to the one recess 18 in the extending direction and aligned along the second direction. Similarly, in the plurality of recesses 18, the wire side opening rim 19B of one recess 18 overlaps with the wire side opening rims 19B, 19B of another two recesses 18, 18 in the extending direction, and the another two recesses 18, 18 are arranged adjacent to the one recess 18 in the extending direction and aligned along the second direction. Accordingly, when a force is applied to the electric wire toward the end side and also toward the opposite direction of the end side, a holding force of the wire barrel 16 for holding the core wire 13 is increased.

According to the present embodiment, a plurality of recesses 18 are aligned along the first direction with a relatively small pitch distance P1 that is from 0.1 mm to 0.8 mm. This increases the number of recesses 18 in a unit area. This also increases a total area occupied by the edges formed on the rims of the opening of the recesses 18 in the unit area. Accordingly, a total area of the core wire 13 which the edges formed on the rims of the opening of the recesses 18 bite into is relatively increased. This increases the holding force of the wire barrel 16 for holding the core wire 13.

If the distance between the recesses 18 is excessively small, an excessive load is applied to the die in press working of a metal plate material for forming the female terminal connector 12 with the die. Therefore, it is not preferable. According to the present embodiment, the distance L2 between the recesses 18 that are arranged adjacent to each other in the first direction is set to be 0.1 RR or more. It is suppressed that an excessive load is applied to the die for molding the recesses 18.

The distance between the recesses 18 that are arranged adjacent to each other in the first direction is set to be a half or less of the pitch distance P1 between the recesses 18 in the first direction. Accordingly, one of the recesses 18 and other recess 18 that is arranged adjacent to the one recess 18 in the extending direction are arranged so as to overlap with each other in the extending direction.

According to the present embodiment, the recesses 18 are aligned along the extending direction with a relatively small pitch distance P2 that is from 0.3 mm to 0.8 mm. This increases the number of the recesses 18 in a unit area. This also increases a total area occupied by the edges formed on the rims of the opening of the recesses 18 in the unit area. Accordingly, a total area of the core wire 13 which the edges formed on the rims of the opening of the recesses 18 bite into in the unit area is relatively increased. This increases the holding force of the wire barrel 16 for holding the core wire 13.

If the distance between the recesses 18 is excessively small, an excessive load is applied to the die in press working of a metal plate material for forming the terminal connector with the die. Therefore, it is not preferable. On the other hand, if a width of the recess 18 in the extending direction is excessively small, a width of the protruding part of the die for forming the recess 18 is also excessively small. This applies an excessive force to the die and this is not preferable.

According to the present embodiment, the distance L5 between the recesses 18 that are arranged adjacent to each other in the extending direction is set to be 0.1 mm or more. This suppresses an excessive load from being applied to the die in press working. Further, the distance L5 between the recesses 18 that are arranged adjacent to each other in the extending direction is set to be the value or less that is obtained by subtracting 0.1 mm from the pitch distance P2 between the recesses 18 in the extending direction. This suppresses an excessive load from being applied to the die for molding the recesses 18.

The first inclined surface 22 connecting the first opening rim 19 of the recess 18 and the bottom surface of the recess 18 is formed to have an angle $\alpha$ of 105 degrees with respect to the surface of the wire barrel 16 where the core wire 13 is arranged. As is described before, the recesses 18 are formed by compressing the protruding parts formed in the die to the metal plate material. The inclined surfaces 21 that are inclined to spread from the bottom surface of the recess 18 toward the rims of the opening of the recess 18 are formed between the rims of the opening of the recess 18 and the bottom surface of the recess 18 so as to easily separate the protruding parts of the die from the metal plate material after pressing. In other words, an obtuse angle is formed by the inclined surface 21 and the surface of the wire barrel 16 where the core wire 13 is arranged.

The angle $\alpha$ formed by the inclined surface 21 and the surface of the wire barrel 16 where the core wire 13 is provided is great. This means that the rim of the opening of the recess 18 has a gentle edge. In the present embodiment, the angle $\alpha$ formed by the first inclined surface 22 and the surface of the wire barrel 16 where the core wire 13 is provided is 105 degrees, which is a relatively small obtuse angle. Therefore, the first opening rim 19 of the recess 18 has a relatively steep edge. Therefore, the edges formed on the first opening rims 19 bite into the core wire 13 to surely remove the oxide layer formed on the core wire 13.

In the present embodiment, the core wire 13 is formed of aluminum alloy. If the core wire 13 is formed of aluminum alloy, the oxide layer is relatively easy to be formed on the surface of the core wire 13. The present embodiment is effective in the case in that the oxide layer is formed on the surface of the core wire 13.

The wire barrel 16 is required to be crimped onto the core wire 13 with a low compression rate (high compression) to remove the oxide layer formed on the surface of the core wire 13 and reduce the contact resistance. According to the present embodiment, the wire barrel 16 is crimped onto the electric wire 11 with a relatively low compression rate (high compression) that is from 40% to 70%. Therefore, the oxide layer formed on the surface of the core wire 13 is effectively removed. The compression rate may be changed within the above range. For example, the compression rate may be set to be from 50% to 60%, and if the cross-sectional area of the conductor of the electric wire 11 is large, the compression rate may be set to be from 40% to 50%.

According to the present embodiment, a relatively great stress is applied to the core wire 13 corresponding to the areas of the wire barrel 16 between the recesses 18. Accordingly, the oxide layer formed on the surface of the core wire 13 is exactly removed by the rims of the opening of each recess 18 such that the surface of the core wire 13 emerges. This reduces the contact resistance between the core wire 13 and the wire barrel 16.

OTHER EMBODIMENTS

The present invention is not limited to the aspects explained in the above description made with reference to the drawings. The following aspects may be included in the technical scope of the present invention, for example.

(1) In the present embodiment, the angle formed by the extending direction of the electric wire 11 and the first opening rim 19 is substantially 90 degrees. However, the angle is not limited thereto but may be set to be any degrees suitable for intended application.

(2) In the present embodiment, the rims of the opening of the recess 18 form a parallelogram. However, the rims of the opening of the recess may form any quadrangular shapes suitable for intended application such as a square having no parallel sides, a trapezoidal shape, a diamond shape, a rectangular shape and a square.

The invention claimed is:

1. A terminal connector comprising:

a crimping portion that is crimped onto a conductor exposed at an end of an electric wire so as to surround the exposed conductor, wherein in a state before the crimping portion is crimped onto the electric wire, a plurality of recesses are arranged on a surface of the crimping portion where the electric wire is provided, so as to be aligned along a first direction with a distance therebetween, the first direction crossing to an extending direction in which the electric wire that is crimped onto the crimping portion is extended, and the plurality of recesses are arranged to be aligned along a second direction with a distance therebetween, the second direction crossing to the extending direction and being different from the first direction, and rims of an opening of each recess form a parallelogram not including a rectangle and comprise two first opening rims parallel to the first direction and two second opening rims parallel to the second direction, and the first opening rims of each of the recesses that are arranged in the first direction are arranged on a straight line along the first direction and the second opening rims of each of the recesses that are arranged in the second direction are arranged on a straight line along the second direction, and wherein the recesses are formed by pressing the crimping portion with a die where a plurality of protruding parts are formed so as to correspond to the recesses.

2. The terminal connector according to claim 1, wherein in a state before the crimping portion is crimped onto the electric wire, each first opening rim forms an angle ranging from 85 degrees to 90 degrees with respect to the extending direction.

3. The terminal connector according to claim 2, wherein in a state before the crimping portion is crimped onto the electric wire, the opening rims of each recess is connected to a bottom surface of each recess by four inclined surfaces that spread from the bottom surface of each recess toward the opening rims of each recess, and an angle formed by a first inclined surface and a surface of the crimping portion where the electric wire is provided and no recess is formed is from 90 degrees to 110 degrees, the first inclined surface being one of the four inclined surfaces and connecting the first opening rim and the bottom surface of each recess.

4. The terminal connector according to claim 1, wherein in a state before the crimping portion is crimped onto the electric wire, a pitch distance P1 between the recesses in the first direction is from 0.1 mm to 0.8 mm.

5. The terminal connector according to claim 4, wherein in a state before the crimping portion is crimped onto the electric wire, a distance between the recesses that are arranged adjacent to each other in the first direction is 0.1 mm or greater and a half or less of the pitch distance P1 between the recesses in the first direction.

6. The terminal connector according to claim 1, wherein in a state before the crimping portion is crimped onto the electric wire, a pitch distance P2 between the recesses in the extending direction is from 0.3 mm to 0.8 mm.

7. The terminal connector according to claim 6, wherein in a state before the crimping portion is crimped onto the electric wire, a distance between the recesses that are arranged adjacent to each other in the extending direction is 0.1 mm or greater and the distance is set to be a value or less that is obtained by subtracting 0.1 mm from the pitch distance P2 between the recesses in the extending direction.

8. The terminal connector according to claim 1, wherein in a state in that the crimping portion is crimped onto the electric wire, the first opening rims have an end side opening rim that is positioned closer to an end side of the electric wire, and in a state before the crimping portion is crimped onto the electric wire, a length of the end side opening rim is set to be a distance between the end side opening rims of two recesses that are aligned along the first direction or more, and wherein the end side opening rim of one of the plurality of recesses overlaps with the end side opening rims of the plurality of recesses in the extending direction, the plurality of recesses being arranged adjacent to the one recess in the extending direction and aligned in the second direction.

9. The terminal connector according to claim 8, wherein in a state before the crimping portion is crimped onto the electric wire, an angle β formed by the extending direction and the second direction is set such that the end side opening rim of one of the plurality of recesses overlaps with the end side opening rims of another plurality of recesses in the extending direction, the another plurality of recesses being arranged adjacent to the one recess in the extending direction and aligned in the second direction.

10. The terminal connector according to claim 8, wherein the end side opening rim of one recess of the recesses overlaps with the end side opening rims of another plurality of recesses of the recesses in the extending direction, and the another plurality of recesses are arranged adjacent to the one recess in the extending direction and aligned along the first direction.

11. The terminal connector according to claim 1, wherein in a state in that the crimping portion is crimped onto the electric wire, the first opening rims have a wire end opening rim that is positioned closer to an opposite side from an end side of the electric wire, and in a state before the crimping portion is crimped onto the electric wire, a length of the wire side opening rim is set to be a distance between the wire end opening rims of two recesses that are aligned in the first direction or more, and wherein the wire side opening rim of one of the plurality of recesses overlaps with the wire side opening rims of the plurality of recesses in the extending direction, the plurality of recesses being arranged adjacent to the one recess in the extending direction and aligned in the second direction.

12. The terminal connector according to claim 11, wherein in a state before the crimping portion is crimped onto the electric wire, an angle β formed by the extending direction and the second direction is set such that the wire side opening rim of one of the plurality of recesses overlaps with the wire side opening rims of another plurality of recesses in the extending direction, the another plurality of recesses being arranged adjacent to the one recess in the extending direction and aligned in the second direction.

13. The terminal connector according to claim 11, wherein the wire side opening rim of one recess of the recesses overlaps with the wire side opening rims of another plurality of recesses of the recesses in the extending direction, and the another plurality of recesses are arranged adjacent to the one recess in the extending direction and aligned along the first direction.

14. An electric wire with a terminal connector comprising:

an electric wire having a conductor; and the terminal connector according to claim 1, the terminal connector being crimped onto an end of the electric wire.

15. The electric wire with a terminal connector according to claim 14, wherein the conductor is formed of aluminum or aluminum alloy.

16. The electric wire with a terminal connector according to claim 14, wherein when a compression rate of the conductor that is crimped onto the crimping portion is expressed by a percent of a cross-sectional area of the conductor after being crimped onto the crimping portion with respect to a cross-sectional area of the conductor before being crimped onto the crimping portion, the compression rate is from 40% to 70%.

* * * * *